US010550631B2

(12) United States Patent
Wang

(10) Patent No.: US 10,550,631 B2
(45) Date of Patent: Feb. 4, 2020

(54) CLOSURE FIRE RATED FRAME EXTRUSION COMPONENT AND A METHOD OF MAKING THE SAME

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 16/355,363

(22) Filed: Mar. 15, 2019

(65) Prior Publication Data

US 2019/0242179 A1 Aug. 8, 2019

(51) Int. Cl.
*E06B 5/16* (2006.01)
*E06B 1/32* (2006.01)
*E06B 1/30* (2006.01)

(52) U.S. Cl.
CPC ..... *E06B 5/168* (2013.01); *E06B 1/30* (2013.01); *E06B 1/32* (2013.01)

(58) Field of Classification Search
CPC ... E06B 5/168; E06B 1/30; E06B 1/32; E06B 5/16; E06B 5/161
See application file for complete search history.

(56) References Cited

U.S. PATENT DOCUMENTS 4,341,831 A * 7/1982 Kleiss ..... C08J 5/124 156/313
6,003,277 A * 12/1999 Graham ..... B29C 44/22 49/504
6,327,826 B1 * 12/2001 Mann ..... E06B 5/161 52/1
6,453,631 B1 * 9/2002 Headrick ..... B29C 44/12 49/504
6,530,183 B1 * 3/2003 Kuei-Yung ..... E06B 1/26 49/504
6,606,831 B2 * 8/2003 Degelsegger ..... E06B 3/20 52/204.1
6,981,351 B2 * 1/2006 Degelsegger ..... E06B 3/025 52/784.11
8,042,316 B2 * 10/2011 Lee ..... E06B 3/5892 52/204.71
9,593,222 B2 * 3/2017 Taylor ..... B29C 44/38
(Continued)

FOREIGN PATENT DOCUMENTS

CN 207092824 U 3/2018
DE 19816913 A1 10/1999
GB 2535511 A * 8/2016 ..... E02B 1/28

OTHER PUBLICATIONS

Combined Search and Examination Report dated Aug. 20, 2019 issued in corresponding United Kingdom Patent Application No. GB1903684.7.

*Primary Examiner* — Rodney Mintz
(74) *Attorney, Agent, or Firm* — Ostrolenk Faber LLP

(57) ABSTRACT

An extrusion component of a closure frame for defining an opening which is closable by a closure member and a method of making the same. The extrusion component comprises an elongate body having first and second sides, at least one of which is shaped for accommodating said closure member. The elongate body includes an outer layer integrally formed with an inner layer and the inner layer has an outer surface correspondingly shaped by or with an inner surface of the outer layer.

28 Claims, 13 Drawing Sheets

(56) References Cited

U.S. PATENT DOCUMENTS

| | | | | |
|---|---|---|---|---|
| 9,845,633 | B2 * | 12/2017 | Wang | E06B 1/366 |
| 2010/0175322 | A1 * | 7/2010 | Lee | E06B 3/5892 49/70 |
| 2017/0328117 | A1 * | 11/2017 | Wang | E06B 1/366 |

* cited by examiner 200A
206
202
203
204
201
205B
205C
205A
205
207
200B/200C

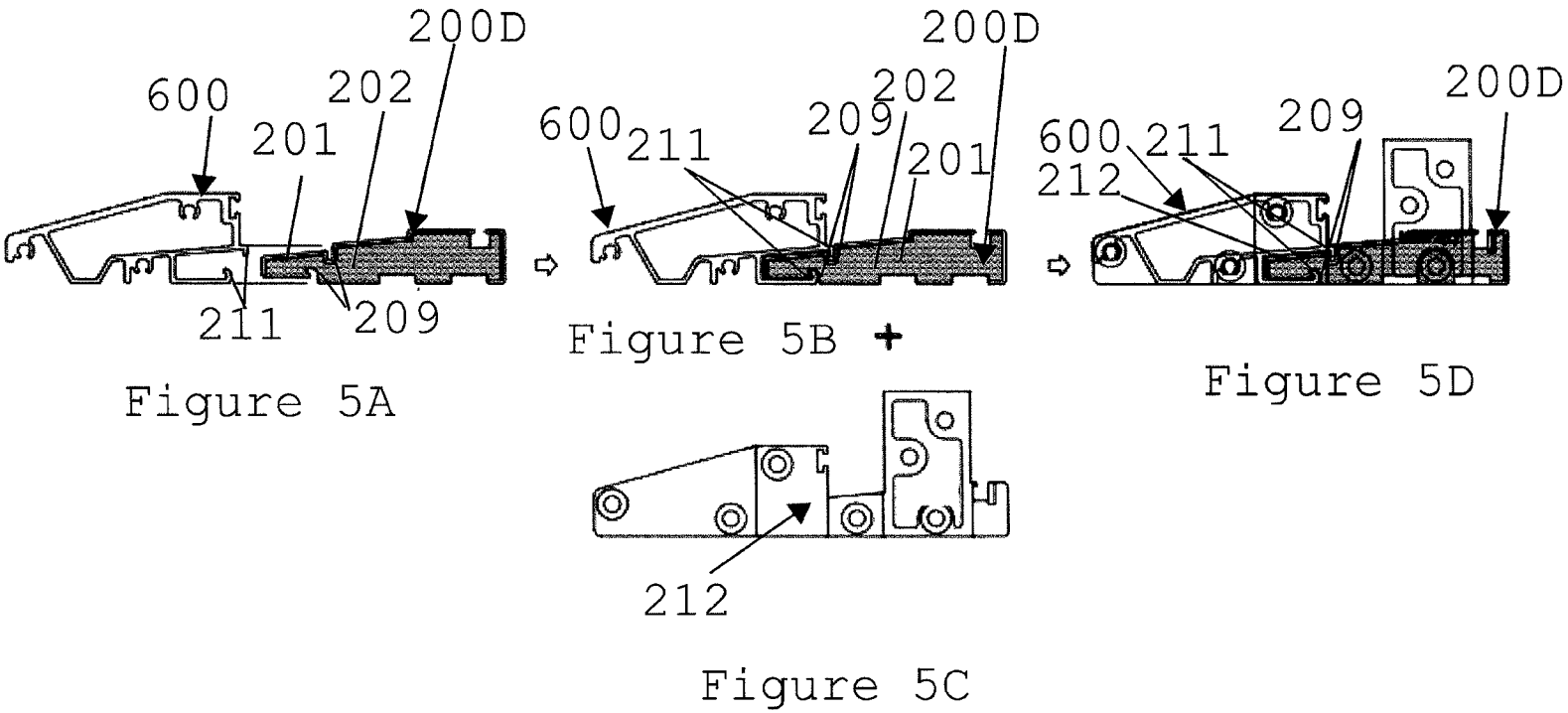
Figure 5A + Figure 5B + Figure 5C = Figure 5D

Properties of resulting dual layered closure component (1) Properties of the the outer layer of the closure component

| Properties | Standard | Value |
|---|---|---|
| Weather resistance (ΔE) | BS EN ISO11341:2004 | <3.5 |
| Gloss | ASTM D523 | 60-70 |
| Hardness (shore D) | ASTM D2240 | >70 |
| IZODkg-cm/cm2(25°C) | ASTM D256 | >55 |
| IZODkg-cm/cm2(-10°C) | ASTM D256 | >30 |
| HDT(°C) | ASTM D648 | 65-69 |

Figure 14A (2) Properties of the inner layer of the closure component

| Properties | Standard | Value | Note |
|---|---|---|---|
| Fire resistance | BS EN 1634 | 30 Minutes | Up to 40 Minutes |
| Sound insulation | | 20db | 40db without foaming agent |
| Thermal insulation | DIN52616 | 0.05-0.07 W/M*K | PVC 0.16 W/M*K without foaming agent |
| Hardness (shore D) | ASTM D2240 | >65 | |
| Density (g/cm3) | ASTM D792 | 0.6~1.4 | 1.4 without foaming agent |

Figure 14B

CLOSURE FIRE RATED FRAME EXTRUSION COMPONENT AND A METHOD OF MAKING THE SAME

The present invention relates to a closure fire rated frame component for example particularly, but not exclusively, a door or window frame component formed by extrusion that can be assembled to form a door or window frame.

BACKGROUND OF THE INVENTION

A closure frame is an assembly of frame components arranged into a preferred shape. These frame components may be formed from solid wood or plastic hollow structure produced by extrusion. An example of such closure frame would be a doorframe which usually includes jambs and upper transverse member enclosing the sides and top of a doorway. The doorframe supports a door that is useful in closing of the doorway. Another example of a closure frame would be a window frame which encloses sides, top and bottom of a window usually covered with a glass pane.

Closure frames made of solid wood may have relatively high shock and sound absorption abilities but their fire resistance capability would be comparatively low. With in mind a more economical substitute for reasonable mechanical strength and fire resistance properties, plastic doorframe is made available. The component forming the doorframe are usually hollow structure defined or bounded by a single layer plastic skin that is created with a fixed cross-sectional profile by way of extrusion. The presence of a hollow interior may compromise the mechanical strength of the overall frame. Wooden blocks may be inserted into the hollow interior for supporting the installation of locks or other accessories. Such wooden block should offer some enhancement of mechanical strength but other properties such as fire resistance capability demand improvement at reasonable costs.

The invention seeks to eliminate or at least to mitigate such shortcomings for enhanced performance by providing a new or otherwise improved closure frame component.

SUMMARY OF THE INVENTION

According to the invention, there is provided an extrusion component of a closure frame for defining an opening which is closable by a closure member, comprising an elongate body having first and second sides, at least one of which is shaped for accommodating said closure member; wherein the elongate body includes an outer layer integrally formed with an inner layer and the inner layer has an outer surface correspondingly shaped by or with an inner surface of the outer layer.

Preferably, the inner layer has an inner surface that defines a hollow interior suitable for accommodating a reinforcement insert.

More preferably, the reinforcement insert is in attachment with the inner layer by way of adhesive.

Yet more preferably, the outer layer is formed from polyvinyl chloride (PVC).

Advantageously, the inner layer is formed from polyvinyl chloride (PVC) and a foaming agent.

More advantageously, the foaming agent comprises at least one of 4,4'-Oxybis(benzenesulfonyl hydrazide), sodium bicarbonate and Tricarboxylic acid.

Yet more advantageously, the inner layer further includes a material selected from a group consisting magnesium hydroxide, zinc borate, calcium phosphate and Diatomaceous earth It is advantageous that the reinforcement insert comprises wood material for supporting installation of one or more accessories.

Preferably, the first side of the elongate body includes a shaped retainer integrally formed therewith for retaining an external part to be attached to the first side of the elongate body.

More preferably, the first side of the elongate body includes an extension part integrally formed thereto and spaced apart from the retainer for engaging said closure member.

Yet more preferably, the retainer and the extension part run parallel to each other along the length of the elongate body and define a receiving zone for accommodating said closure member therein.

It is preferable that the second side is at least partially devoid of an outer layer thereby exposing the inner layer.

Preferably, the second side is a mirror image of the first side.

Advantageously, the receiving zone includes a coupling part that couples with a co-operable coupling part on a bead for co-operatively holding a pane of glass.

More advantageously, the coupling part is connected to the receiving zone by way of a connector.

Yet more advantageously, the retainer is shaped to engage a projection on the bead for fixing relative position of the extrusion component and the bead.

In a second aspect of the invention there is provided an extrusion component assembly comprising two extrusion components detailed above, wherein the extrusion components are connected by a connector and with their second sides arranged next to one another.

Preferably, the second sides of the extrusion components defines a gap into which a spacer is placed.

More preferably, the spacer includes one or more ribs extending from a main body for maintaining the gap.

It is preferable that the gap is concealed by a cover engaging one end of the spacer.

In a third aspect of the invention there is provided an extrusion component assembly comprising an extrusion component as detailed above coupled to an extension part by way of a coupler.

Preferably, wherein the coupler includes a pair of recesses provided on the first and second sides of the component respectively for accommodating a pair of jaws on the extension part.

More preferably, the assembly is sealed off on opposite sides by respective covers connected thereto by way of connectors.

Yet more preferably, at least one of the first side and the second side includes one or more intumescent strip attached thereto.

In a fourth aspect of the invention, there is provided an extrusion component assembly comprising at least three extrusion components as detailed above and one extrusion component as detailed in the third aspect of the invention connected to one another by way of connectors to form a frame defining an opening therein.

In a fifth aspect of the invention, there is provided an extrusion component wherein the outer layer comprises polyvinyl chloride (PVC) and the inner layer comprises polyvinyl chloride (PVC) and a foaming agent, the overall extrusion component attaining a level of at least 30 minutes in a BS EN 1634 test.

In a sixth aspect of the invention, there is provided a method of forming the closure frame extrusion component as detailed above, wherein the outer and inner layers of material are integrally formed and simultaneously shaped in a same extrusion step.

Preferably, the inner layer of material defines a hollow interior in said same extrusion step for accommodating an insert.

More preferably, the method includes the step of providing a second die inside a first die.

Yet more preferably, the method further includes the step of supplying a first substrate of material between the first and second die and a second substrate into the second die thereby during extrusion, the first substrate of material forms the outer layer of the closure frame component as claimed in claim 1 and the second substrate of material forms the inner layer of the same closure frame component in a single step of extrusion.

BRIEF DESCRIPTION OF DRAWINGS

The invention will now be more particularly described, by way of example only, with reference to the accompanying drawings, in which:

FIG. 14A is a table showing the properties of an outer layer of the closure frame component in FIG. 1; and FIG. 14B is a table showing the properties of an inner layer of the closure frame component in FIG. 1.

DETAILED DESCRIPTION OF PREFERRED EMBODIMENT

In FIGS. 1 to 13B there is shown various embodiments of a fire rated closure frame extrusion component 200 in accordance with the invention and a closure frame extrusion component assembly 100 incorporating one or more of the closure frame extrusion components 200.

The closure frame extrusion component 200 and the resulting frame assembly 100 reaches 30 minutes to 40 minutes integrity and insulation with respect to BS EN 1634 test which is a fire resistance and smoke control tests for door, shutter and, openable window assemblies and elements of building hardware. The fire resisting ability is mainly a contribution of the synergistic effect of the improvement to the structural and chemical constituents of the closure frame extrusion component 200.

Figure 1:
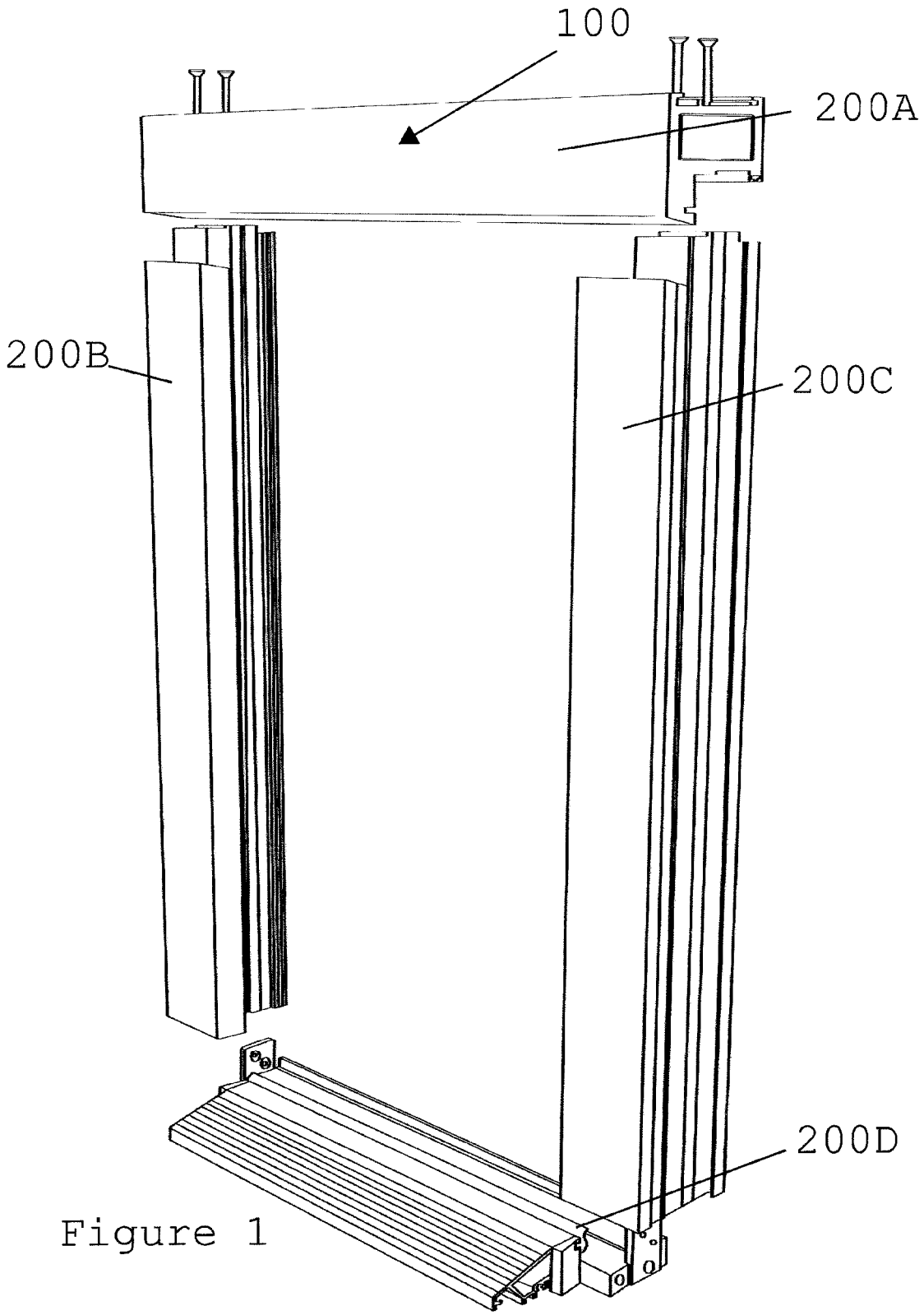
FIG. 1 is a perspective exploded view of a closure frame assembly formed from four closure frame extrusion components in accordance with the invention.

Referring to FIG. 1 there is shown the frame assembly 100 formed by connecting four closure frame extrusion components 200 in accordance with the invention. These components 200 are separate parts formed by way of extrusion including a top component 200A connected to left and right components 200B and 200C and closed off by a bottom component 200D.

These components 200 may be useful in lining a void formed on a structural surface thereby defining an opening which may be a doorway or a window. The assembly functions as a frame of the doorway or window.

All of the components 200A to 200D share a common dual-layered structural construction formed by a single step of extrusion. This structural improvement offers substantial advantage in fire resistance, sound insulation, thermal insulation, hardness and density. More importantly, the die for the outer layer is useful with the die for the inner layer to achieve the end product in a single step with integrity.

Figure 2A:
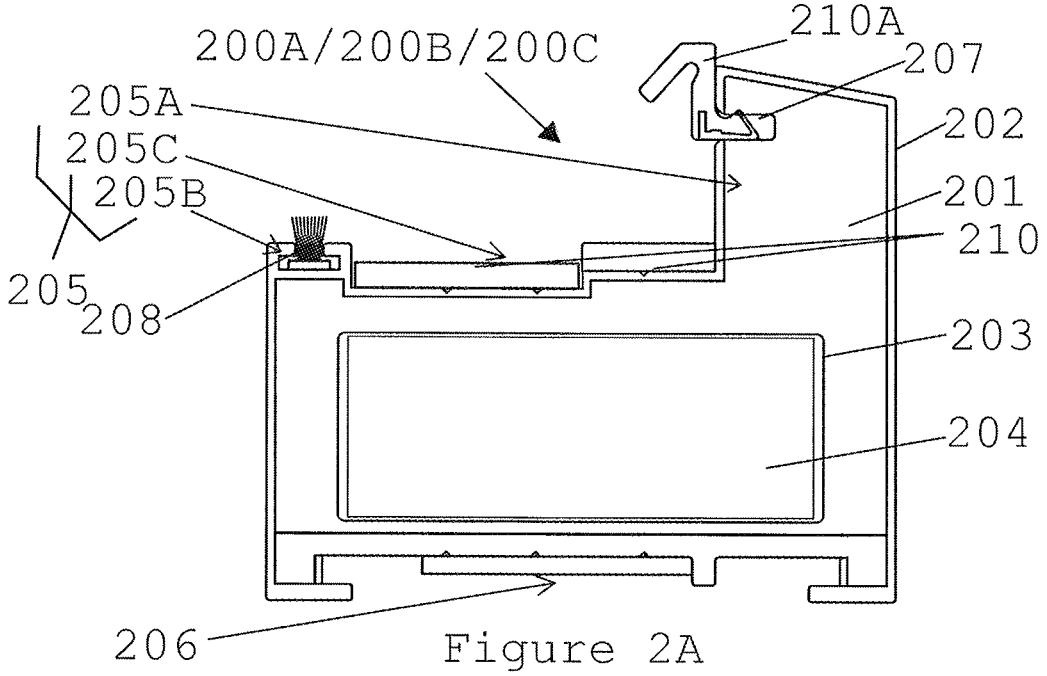
FIG. 2A is a cross-sectional view of top or side closure frame components of FIG. 1 taken across the length thereof.

FIG. 2A shows the cross-sectional view of the component 200A to 200C. It is clear from the drawing that there are identifiable outer and inner layers 201 and 202. The inner layer 202 is much thicker than the outer layer 201. In the preferred embodiment, the inner layer 202 is 4 mm to 30 mm thick and the outer layer 201 is 0.5 mm to 1.5 mm thick. The outer and inner layer 201 and 202 are integrally formed into a one piece structure during the extrusion step such that adhesive is not required for secure the relative positions of the layers.

Figure 13B:
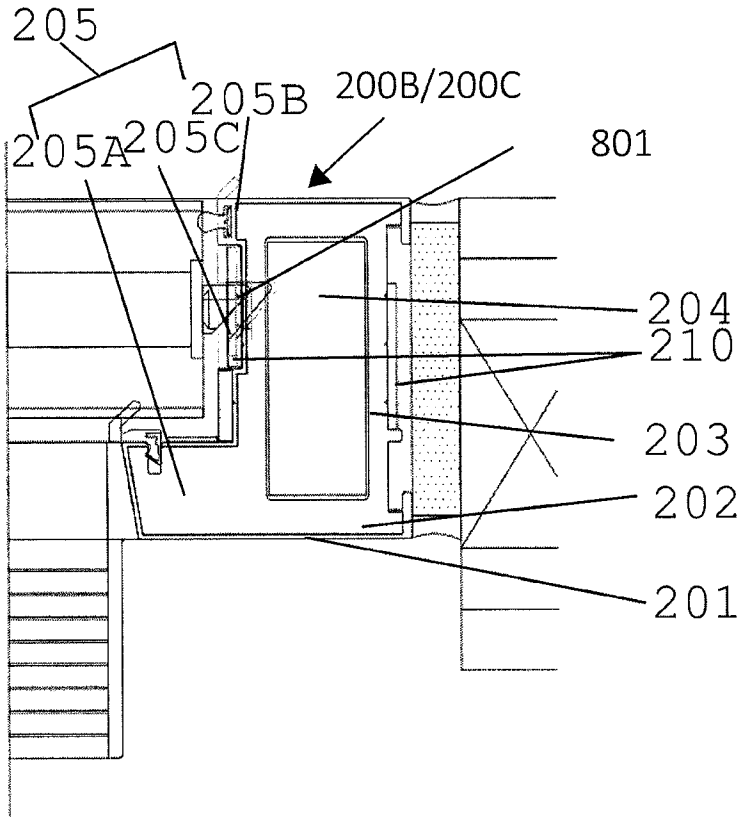
FIG. 13B shows a lock set installed in a side closure frame component and on the closure member.

A hollow interior 203 is defined by or in in the inner layer 202. In the embodiment as shown in FIG. 2A, the hollow interior 203 has a rectangular cross-section. It is dimensioned and shaped for accommodating a reinforcement insert 204 such as a wooden (hard wood) block which may be useful for supporting installation of door accessories such as a door lock as shown in FIG. 13B. In the preferred embodiment, the inner layer 202 comprises a material different from the material that forms the outer layer 201 and they may be formed from different types of PVC. The inner layer 202 is preferably formed from foamed PVC. Such foamed PVC reaches 40 minutes level under BSI1634 test.

In the embodiment as shown in FIG. 2A, the inner layer 202 is partially wrapped around by the outer layer 201, leaving one side opened. The inner layer 202 is exposed at the opened side. More specifically, the outer layer 201 forms an open bracket embracing the inner layer 202.

Figure 2B:
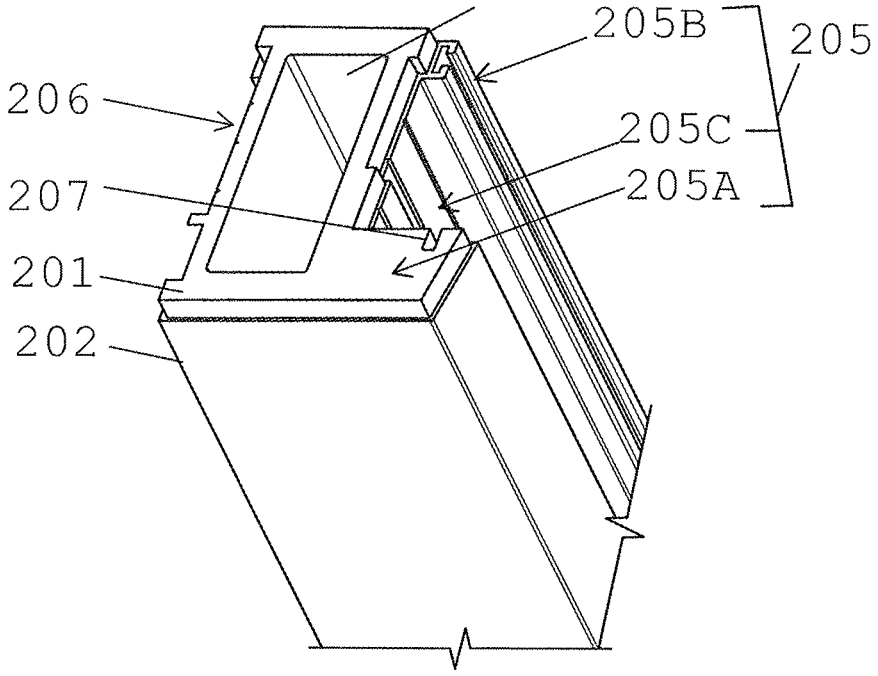
FIG. 2B is an enlarged perspective view of a portion of the closure frame component in FIG. 2A.

As can be seen in FIGS. 2A and 2B, the component 200 has a first side 205 and a second side 206 interconnected by left and right sides. At the first side 205, there is an extension block or an arm 205A and a retaining means 205B both extending therefrom and running parallel to each other thereby defining a receiving zone/recess 205C there between which functions as a receiving zone useful in receiving a closure member 500 of a specific thickness. As can be seen in later drawings such as FIG. 8A, the closure member 500 may have different thickness. For those with the right thickness such as a pane of glass, it may be accommodated in the receiving zone/recess 205C. It is also possible for the closure member 500 such as a door with a greater thickness to rest on the first side 205 and span across the receiving zone/recess 205C and the retaining means 205B. The arm 205A may serves as a stopper to prevent the closure member 500 from going beyond it. The arm 205A is a solid structure with no hollow interior. It does include a gap/recess 207 for holding an air seal or an intumescent strip 210.

The recess/receiving zone 205C is lined with seals or intumescent strips 210.

The retaining means 205B on the first side 205 includes a pair of jaws defining an opening narrower than a hollow interior behind. It may be useful in retaining a brush seal 208. The retaining means 205B is formed with the outer layer 201 by way of extrusion. The brush seal 208 may be replaced by a further intumescent strip depending on need.

Figure 3:
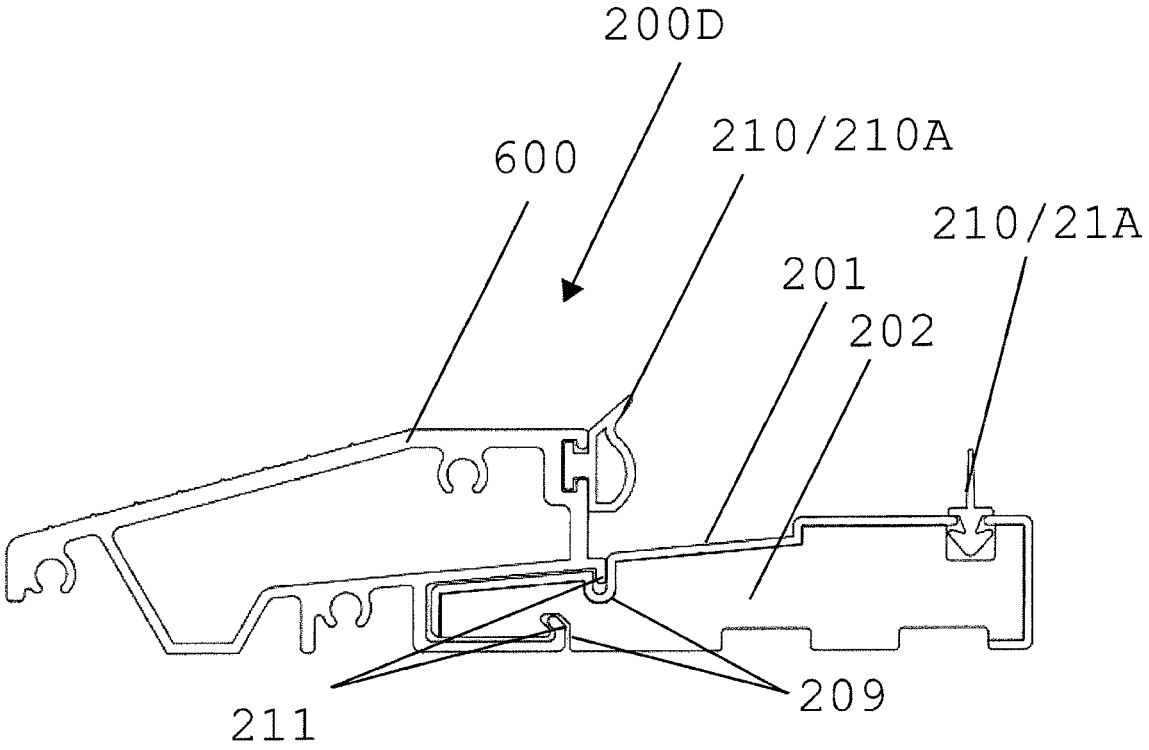
FIG. 3 is a cross-sectional view of a bottom closure frame component of FIG. 1, in connection with an extension part, taken across the length thereof.

The inner layer 202 is exposed on the second side 206 of the component 200 as it is intended for resting on the structural surface in which the opening is formed. One or more intumescent strips 206 is provided on the inner layer 202 which forms the second surface 206 to enhance the fire resisting properties of the component 200. I-shaped cross-section of the bottom component 200D is different from the L-shaped cross-section of component 200A to 200C. As shown in FIG. 3, this component 200D includes an outer layer 201 embracing at least three sides of the inner layer 202. The inner layer 202 is a solid piece of substrate without hollow interior. The component 200D is shaped to couple with an extension part 600. A pair of coupler parts 209 are provided on the first and second opposite sides 205 and 206 of the component 200D respectively for accommodating a pair coupler parts 211 in the form of a pair of jaws on the extension part 600. Coupling 209 and 211 between the component 200D and the extension part 600 comprises male and female couplings.

Figures 4A, 4B, 4C:
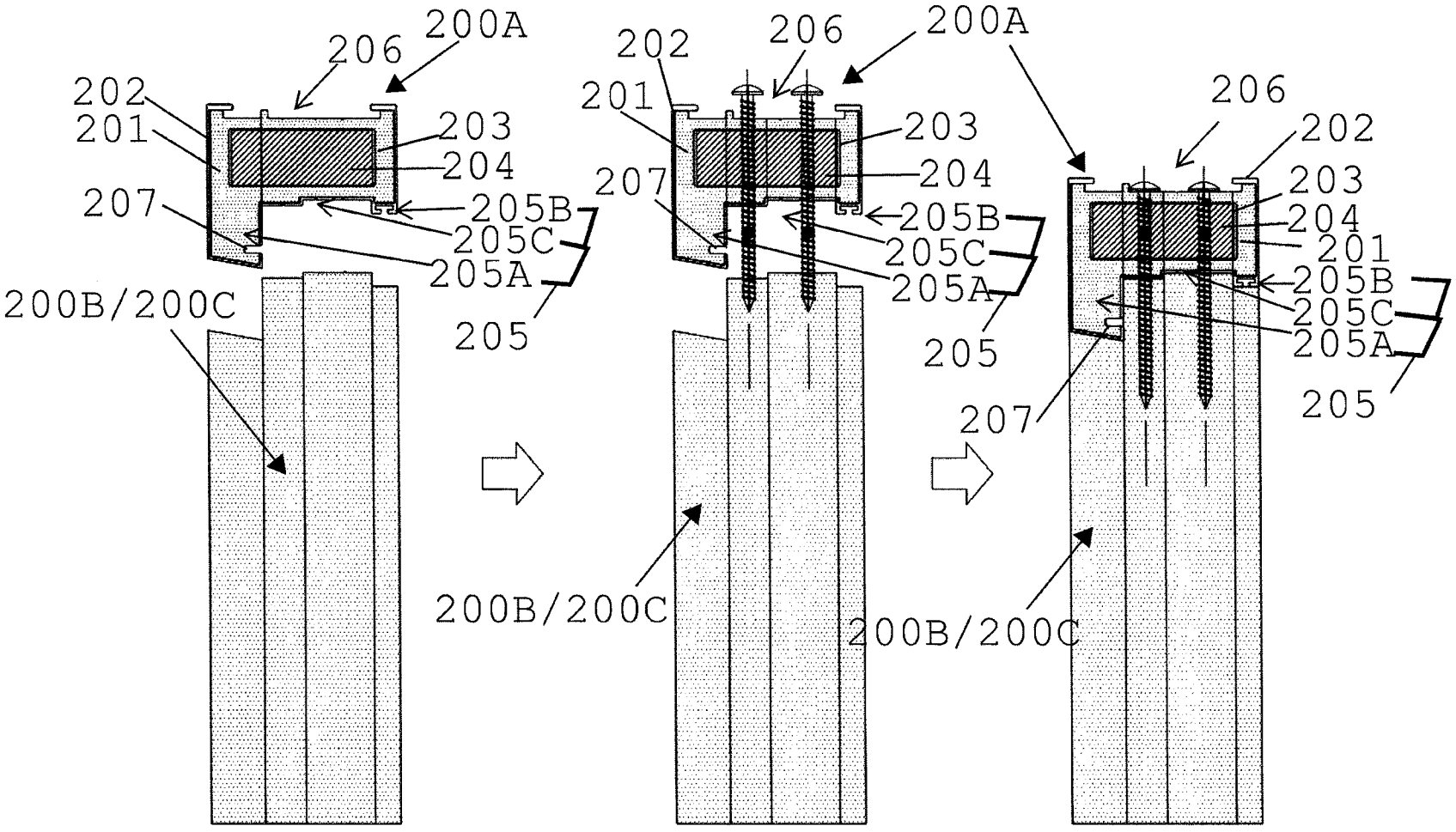
FIG. 4A is a diagram showing a first step of a stepwise connection of one side closure frame component to the top frame component in FIG. 2A.
FIG. 4B is a diagram showing a second step of the stepwise connection of one side closure frame component to the top frame component in FIG. 2A.
FIG. 4C is a diagram showing a third step of the stepwise connection of one side closure frame component to the top frame component in FIG. 2A; Figure SA is a diagram showing a first step of a stepwise connection of the bottom closure frame component to the extension part in FIG. 3.

As shown in FIGS. 4A, 4B and 4C, the top portion of the side components 200B and 200C is shaped complementarily to the first side 205 of the top component 200A for insertion therein and as shown successively in FIGS. 4B and 4C for connection by external connectors such as screws. The complementary inter-connection fixes the relative position of the components 200A, 200B and 200C upon engagement.

Figure 6:
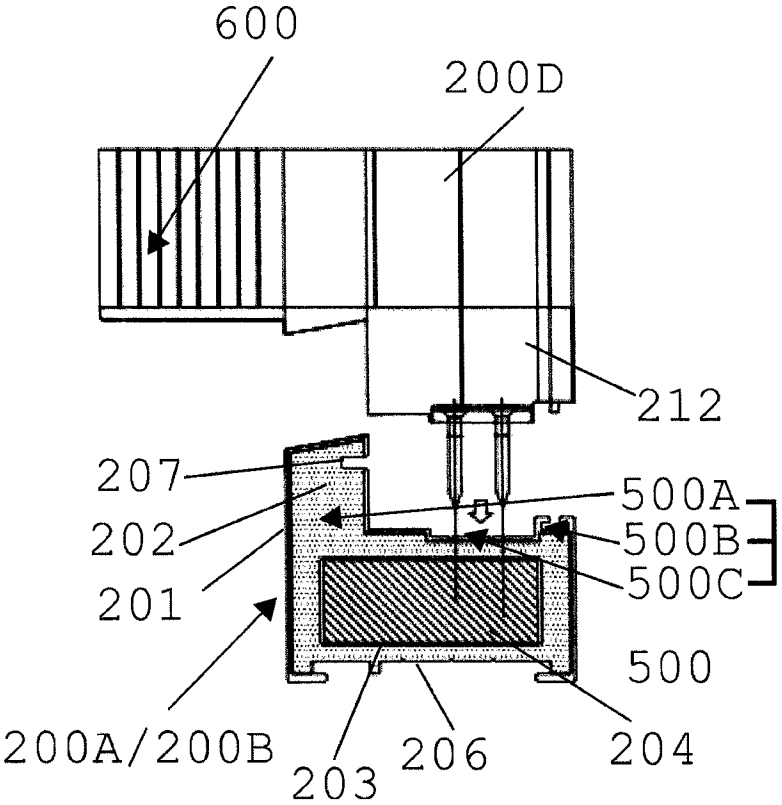
FIG. 6 is a diagram showing connection of the bottom closure frame component and extension part in FIG. 5D to the side closure frame component in FIG. 2A.
Figure 5E:
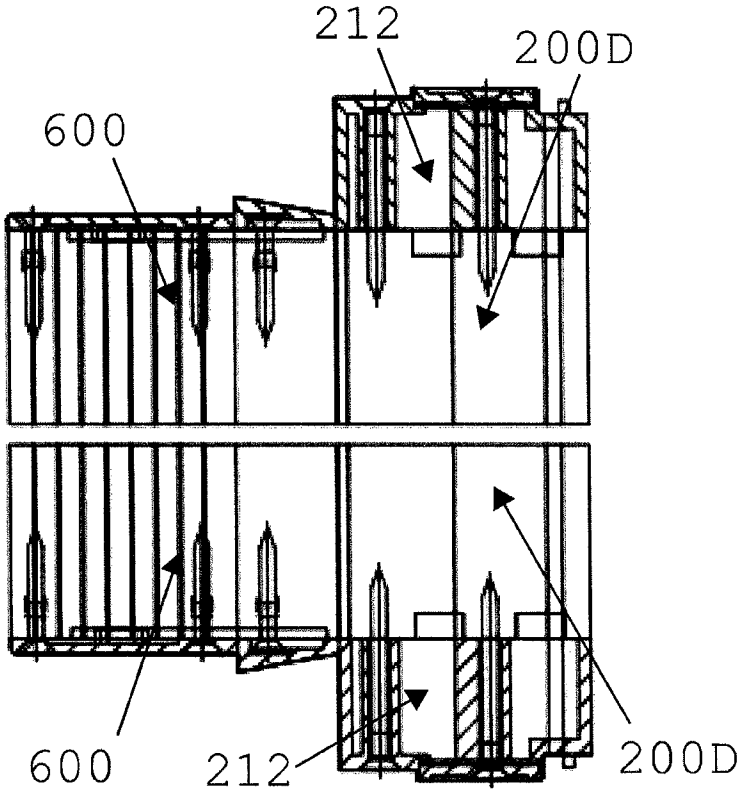
FIG. 5B is a diagram showing a second step of a stepwise connection of the bottom closure frame component to the extension part in FIG. 3.
FIG. 5C is a diagram showing the bottom closure frame component and the extension part connected to a side cover.
FIG. 5D is a diagram showing the bottom closure frame component and the extension part connected to another side cover; Figure SE is a cross-sectional view showing a portion of the bottom closure frame component connected with the extension part and the side covers in FIGS. 5C and 5D.
Figure 7B:
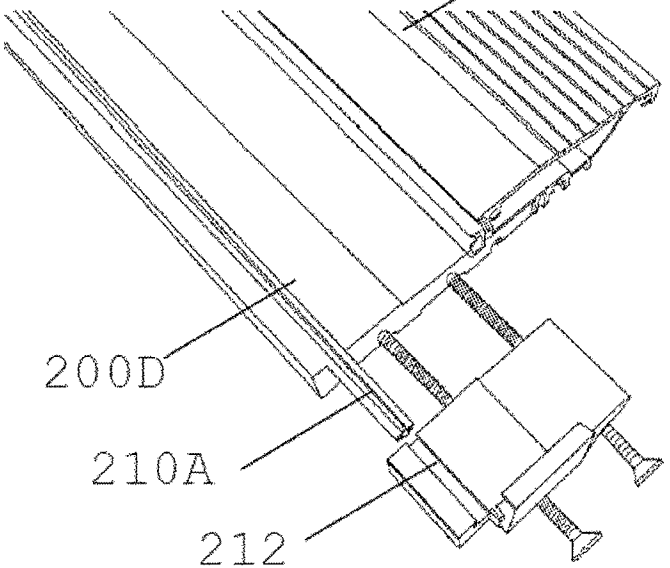
FIG. 7B is a perspective view showing a portion of the bottom closure frame component and the cover in FIG. 5D partially connected.
Figure 7A:
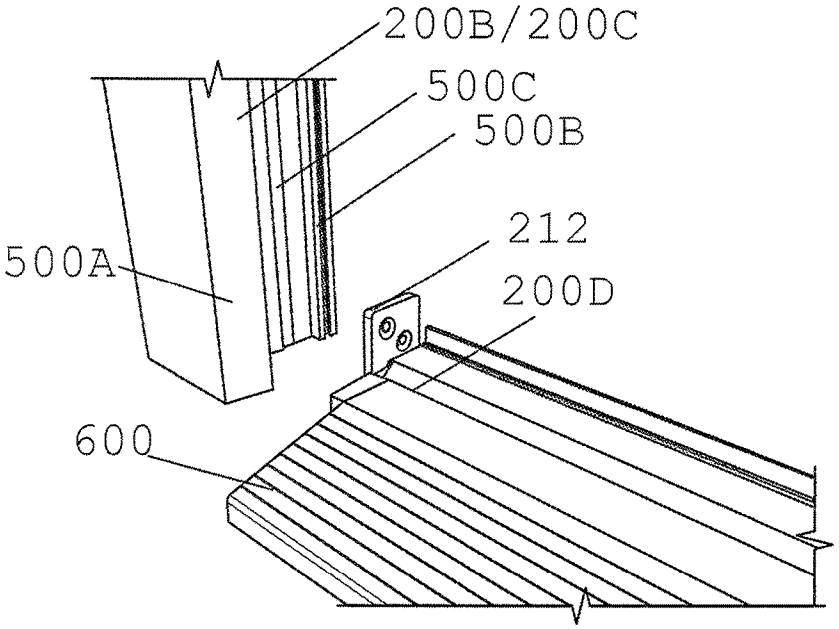
FIG. 7A is a perspective exploded view showing a portion of the bottom closure frame component, the extension part and the side closure frame component in FIG. 6.

Referring to FIG. 5, the bottom component 200D along with the extension part 600 are fixedly attached to two cover plates 212 on its left and right ends by external connectors. As can be seen in FIGS. 6, 7A and 7B, one side of the cover plates 212 is shaped complementary to the first sides 205 of the left or right components 200B and 200C such that the cover plates 212 can be fitted into the first sides 205 of the components 200B and 200C to form a substantially close fitting.

Figure 8A:
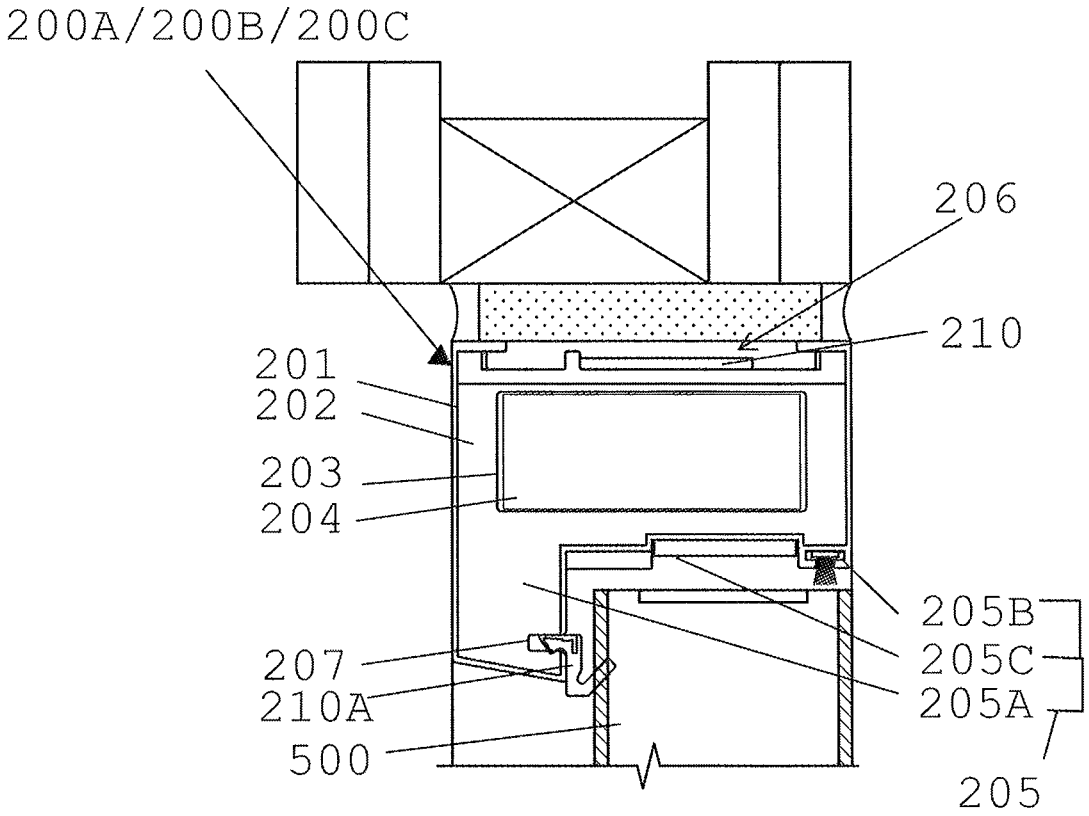
FIG. 8A is a cross-sectional view of the side closure frame component of FIG. 2A in use.
Figure 8B:
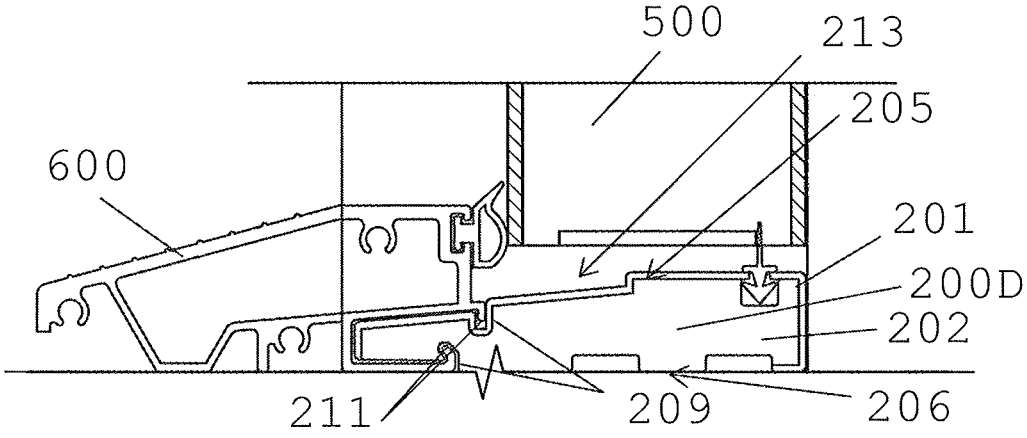
FIG. 8B is a cross-sectional view of the bottom closure frame component of FIG. 5D in use.

Turning to FIG. 8A and FIG. 8B, the component 200B or 200C is shown to be in engagement with a closure member 500 which spans across the receiving zone/recess 205C and the retainer 205B. A gap 213 is formed between the closure member 500 and the first side 205 of the component 200B or 200C. Two seals/intumescent stripes 210A seal or close off the gap 213 from the atmosphere. Referring to FIG. 8B, at the bottom component 200D, a gap 213 is formed between the closure member 500 and the first side 205 of the component 200D as well as a rear surface of the extension part 600. The gap 213 is also sealed off by a seal 208 and/or intumescent strips 210A which may be made of Thermoplastic vulcanizates (TPV).

Figure 9A:
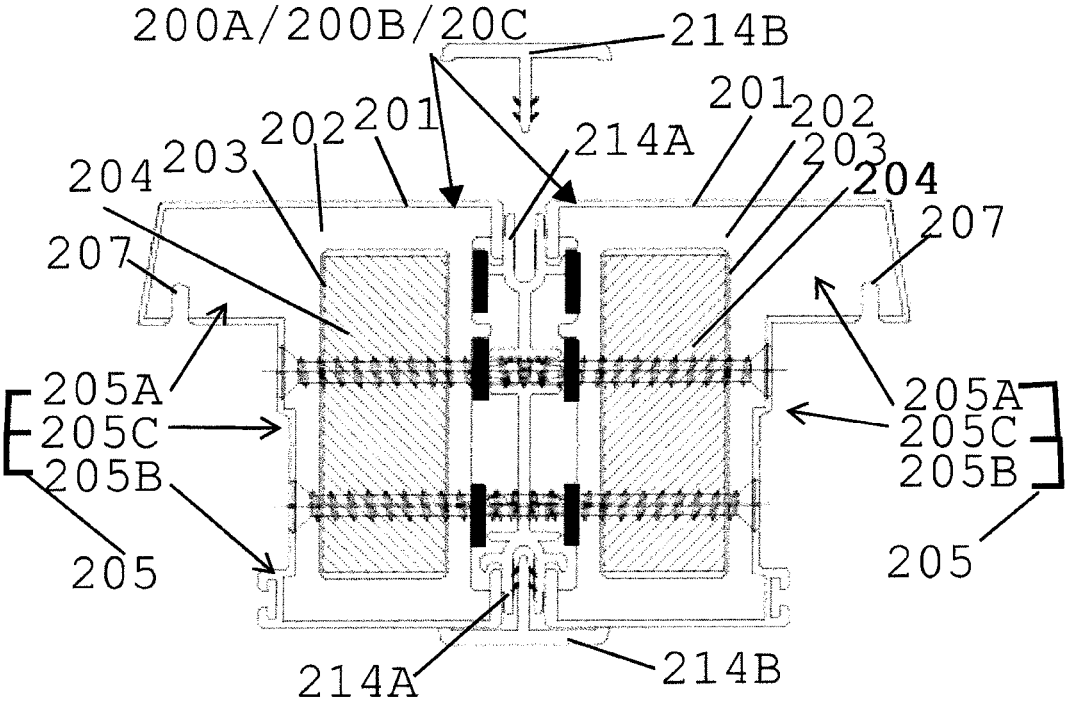
FIG. 9A is a cross-sectional view of a closure frame component assembly formed from back to back connection of two side closure frame components in FIG. 1.

A further embodiment of the component 200E is shown in FIG. 9A. It is an assembly 200E of two identical components 200B or 200C. Such an assembly 200E is useful in establishing side-by-side arrangement of two closure members 500 with respective frames. The closure members 500 may well be two doors or as in FIG. 9B, a glass pane 501 and a door 502.

In the assembly 200E, two components 200B and 200B are connected back to back with their second sides 206 placed adjacent one another. The two components are secured by external connectors and their relative positions are fixed by the cooperation of the connectors and a spacer which is covered by covers/end caps 214A and 214B. The assembly 200E forms a center piece that is connected to six other components 200A, 200B or 200C, 200D to form an integration of two component assemblies 100A and 100B.

Figure 9B:
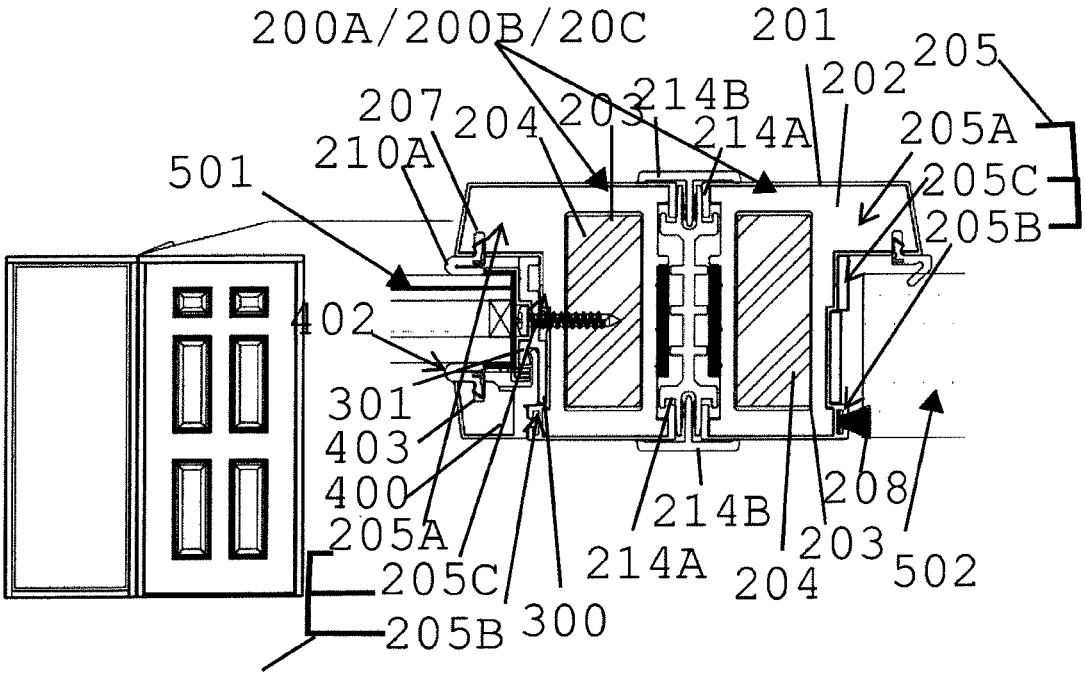
FIG. 9B is an illustrative drawing of the closure frame assembly in FIG. 8A when in use.

As shown in FIG. 9B, the assembly 100A is a window frame assembly while the assembly 100B is a doorframe assembly. The window frame assembly 100A is connected to doorframe assembly through the component 200E.

For the window frame assembly 100A to hold a pane of glass 501, the components 200A to 200D are modified. With reference to FIG. 9B and taking component 200B as an example for illustration, the component 200B is equipped with a seat 300 which is secured to the receiving zone/recess 205C on the first side 205 by way of an external connector. Any intumescent strip in the receiving zone/recess 205C is removed. The seat 300 includes a coupling part 301 for inter-engagement with a corresponding coupling part 401 on a bead 400. As an example, the coupling parts 301 and 401 may be male and female couplers or they may be hooks interengaging with one another. The coupling parts 301 and 401 snap fit with one another to form a secured coupling thereby fixing the relative positions of the bead 400 and the component 200B with the pane of glass 501 held between them. Gap 215 between the glass pane 501 and the component 200B as well as the gap 402 between the glass pane 501 and the bead 400 are sealed off by respective seals 210A which may be in the form of intumescent strip embedded at respective gaps/recess 207 and 403 of the component 200B and bead 400. The seat 300 is made of aluminum.

Figure 13A:
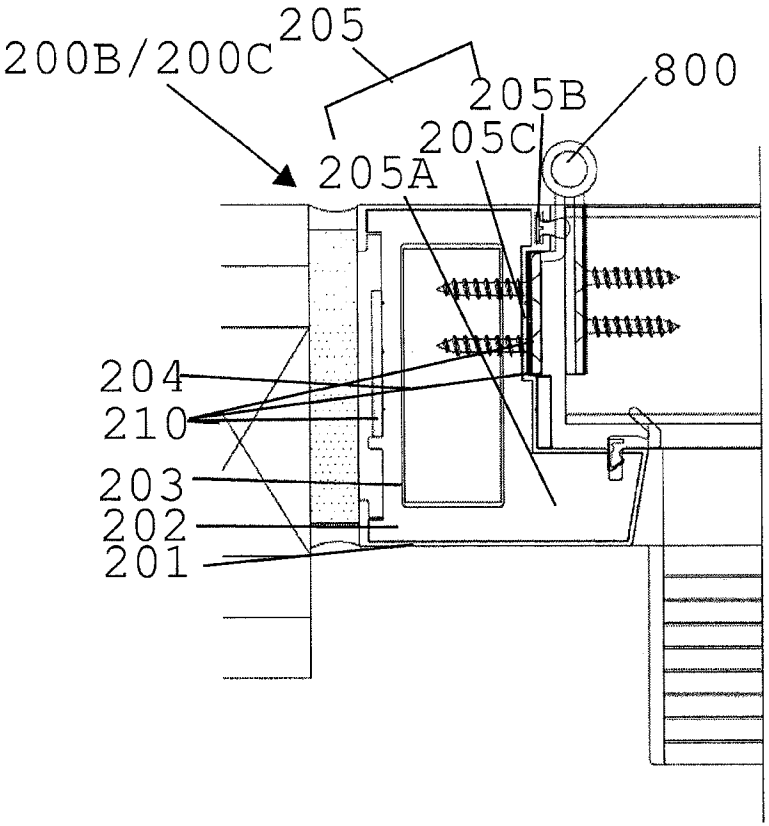
FIG. 13A shows connection of a closure member to a side closure frame component by way of a hinge.

With reference to FIGS. 13A and 13B, for the doorframe assembly 100B, the door 500 is pivotally secured to the component 200C through one or more pivot hinges 800. The retainer 205B holds a seals 210A and the gap 207 is provided on an inner side of the arm 205A for accommodating another seal 210A. The seals 210A may be in the form of an intumescent strips to seal of any gap between the component 200C and the door 502. The component 200B is not in connection with the door 502. It is the receiving end with a seal 210 and a brush 208 provided in the arm 205A and the retainer 205B respectively to seal off and close off any gap 213 between the door 502 and the component 200B. The door 502 spans across the receiving zone/recess 205C and the retainer 205B.

Figure 10A:
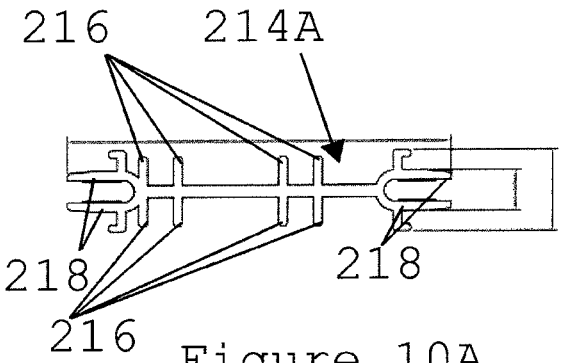
FIG. 10A is an enlarged illustration of an accessory/coupling part as shown in FIGS. 9A and 9B useful in securing relative positions of the closure frame components in FIGS. 9A and 9B.
Figure 10B:
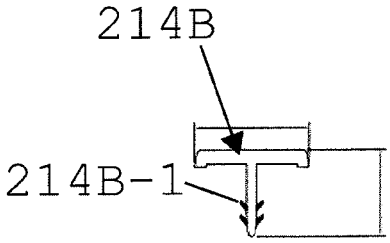
FIG. 10B is an enlarged illustration of an accessory/coupling part as shown in FIGS. 9A and 9B useful in securing relative position of the closure frame components in FIGS. 9A and 9B.

The spacer 214A is shown in FIG. 10A. The end cap 214B is shown in FIG. 10B. The spacer 214A includes ribs 216 specifically constructed for engaging different parts of the second sides of the components 200B. These ribs 216 have different shapes and lengths. The ribs 216 is useful in defining or maintaining the relative positions of the two components 200B. The spacer 214A also includes two end receivers 218 for receiving and fixed connection with the two end caps 214B that closes off gap 215 between the two components 200B. The spacer 214 is made of aluminum while the end caps are made of polyvinyl chloride (PVC) with flexible flaps 214B-1 for sealing.

Figure 10C:
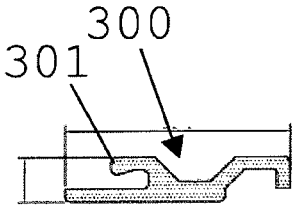
FIG. 10C shows an enlarged illustration of an accessory/coupling part as shown in FIGS. 9A and 9B useful in modifying the closure frame component in FIGS. 9A and 9B for accommodating a pane of glass.
Figure 11:
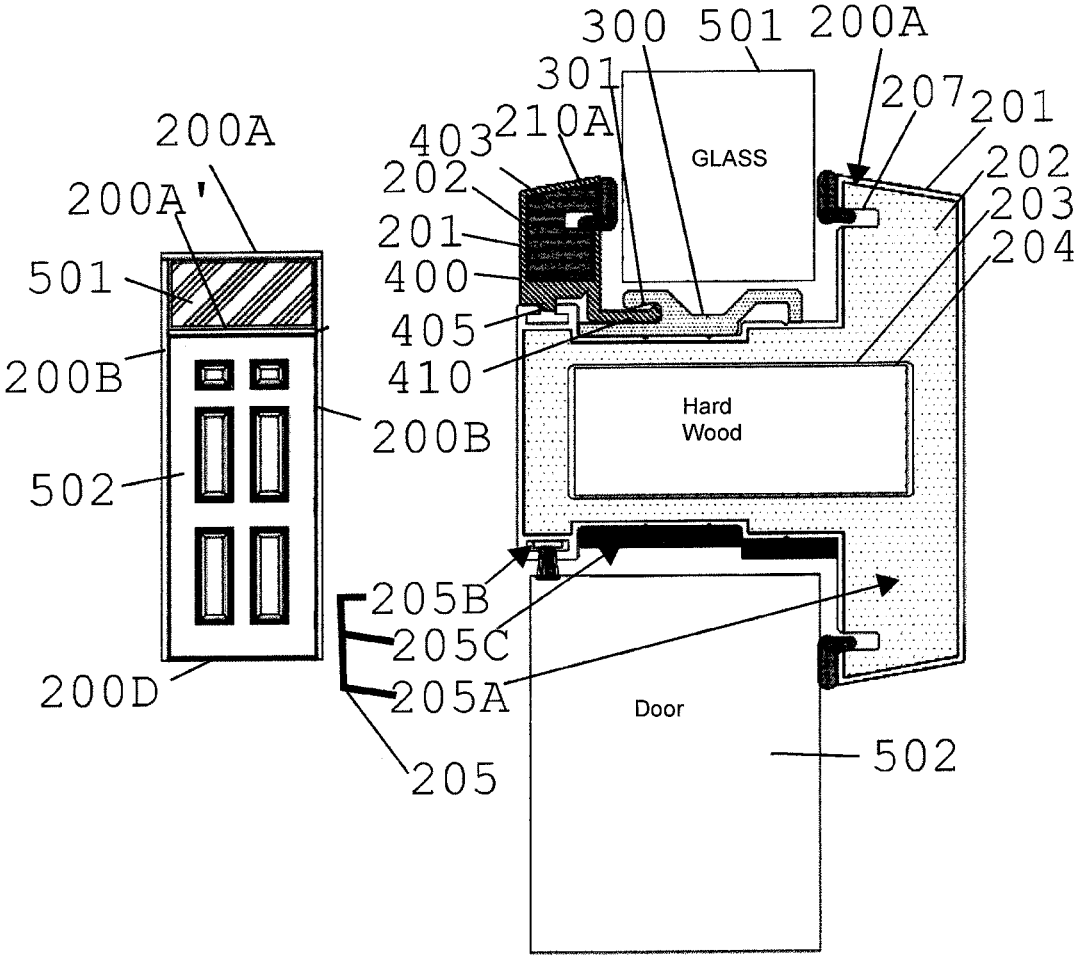
FIG. 11 shows a further embodiment of a closure frame component for accommodating a first closure member on a first side and a second closure member on a second side.
Figure 12A:
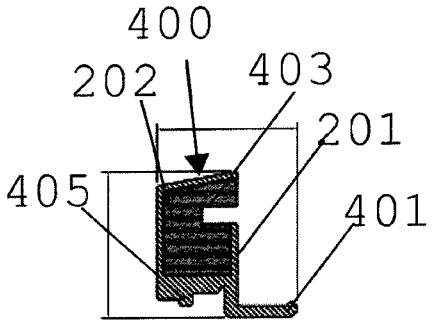
FIG. 12A is an enlarged illustration of an accessory/coupling part as shown in FIG. 11 for use with the closure frame component in FIG. 11.
Figure 12B:
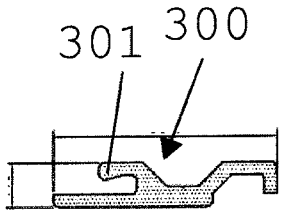
FIG. 12B is an enlarged illustration of an accessory/coupling part as shown in FIG. 11 for use with the closure frame component in FIG. 11.

Now referring to FIG. 11 to 12B, there is shown a different embodiment of the top component 200A. This is an illustrative example and this different embodiment may be used for example as a side component. It has a T-shaped cross-section and the dual layered structure common to all components 200A to 200D. It may be considered as a variant of the embodiment of the component 200E. It is a one piece structure that resembles the component 200E which is an assembly of two components 200B and 200C. For this embodiment, the outer layer 201 covers all sides of the inner layer 202. The inner layer 202 is not exposed to the atmosphere, except at the gaps 207 for receiving the respective seal 210A, and includes a hollow interior 203 for accommodating a reinforcement insert such as a wooden block 204. This top component 200A is substantially symmetrical along at least one dimension e.g. width. Both the first and second sides 205 and 206 includes an arm 205A and 206A as well as a retainer 205B and 206B extending therefrom. On each side 205 and 206 there is a receiving zone/recess 205C and 206C defined between the respective arm 205A, 206A and retainers 205B, 206B. A gap/recess 207 is provided on an inner side of the respective arm 205A and 206A for accommodating a seal 210A. The first and second sides 205 and 206 of the embodiment as shown in FIG. 10 is useful in accommodating a pane of glass 502 and a door 501 respectively. As can be seen in FIG. 11, the component 200A is connected to and along length of left and right components 200B and 200C. The upper end of the left and right components 200B and 200C are connected to a further top component 200A' which resembles that in FIG. 1. The second side 206 of the component 200A together with components 200B, 200C and the further top components 200A' form a window frame assembly 100A for holding a pane of glass 502, while the first side 205 of the component 200A together with components 200B, 200C and 200D form a doorframe assembly 100B for holding a door 501.

On the first side 205, the component 200A is not in connection with the door 502. It is the receiving end with a seal 210A and a brush 208 are provided in the arm 205A and the retainer 205B respectively to seal off and close off any gap 213 between the door 502 and the component 200B. The door 502 spans across the receiving zone/recess 205C and the retainer 205B.

On the second side 206, the component 200A is equipped with a seat 300 which is secured to the receiving zone/recess 205C by way of an external connector. The seat 300 includes a coupling part 301 for coupling with a corresponding coupling part 401 on a bead 400. More specifically the coupling part 301 is in the form of a female coupler and the coupling part 401 on the bead 400 is in the form of a male coupler. The two snap fit with one another to form a secured coupling thereby fixing the relative positions of the bead 400 and the component 200A with the pane of glass 501 held between them. Gap 215 between the glass pane 501 and the component 200A as well as the gap 402 between the glass pane 501 and the bead 400 are sealed off by respective seals 210A which may be in the form of intumescent strip embedded at respective gaps/recess 207 and 403 of the component 200A and bead 400. The seat 300 is made of aluminum. The retainer 205B is useful in receiving a projection from the bead 405 for positioning.

In each embodiment, the bead 400 has the same dual-layer construction as the components 200.

As shown in FIG. 12A, the door 501 is connected to the component 200C by way of one or more hinges 800 and it is locked into place by a door lockset 801 to component 200B.

The hinges 800 and the lockset 801 are connected to the components 200B and 200C by way of external connectors.

The dual layer structure of the components 200A to 200E allows the resulting component 200A to 200E to exhibit all the preferred properties. The outer and inner layers 201 and 202 with different advantageous properties, which complement one another to bring about the overall improvements.

Various properties of the outer layer 201 of the closure frame extrusion component 200 are provided in FIG. 14A where the weather resistance ΔE is less than 3.5 under BS EN ISO11341:2004, Gloss is 60 to 70 under ASTM D523, hardness measured using shore durometer is larger than 70 under ASTM D2240, impact resistance IZOD kg-cm/cm2 at 25 degree Celsius is larger than 55 under ASTM D256, heat deflection temperature HDT in degree Celsius is about 65-69 under ASTM D648.

The properties of the inner layer 202 of the closure frame extrusion component 200 are provided in FIG. 14B. The fire resistance is 30 minutes to 40 minus under BS EN 1634, the sound insulation is 20 db, the thermal insulation/conductivity is 0.05-0.07 W/M*K under DIN52616, the hardness measured by the shore durometer is larger than 65 under ASTM D2240 and the density (g/cm3) is about 0.6/1.4 under ASTM D792.

The inner layer 202 comprises foam PVC material that does not contain any flame retardant banned by the European Union. The foamed PVC inner layer 202 has a fire resistance of 40 minutes under BS11634 standard. It also has sound and heat insulation effect. In more detail, the fire resistance ability of the overall frame assembly 100 is mainly attributable to the properties of the inner layer 202. The foamed PVC material contains flame retardant magnesium hydroxide, zinc borate, diatomaceous earth and calcium phosphate. The foaming agent is the key to the improving flame retardancy of the resulting layer.

(1) The decomposition reaction of magnesium hydroxide on heating (340-490° C.) is as follows $$Mg(OH)2 \rightarrow MgO+H2O$$

It absorbs the heat from a surface of the combusting material to achieve the fire retardation ability. It also releases a lot of water to dilute the oxygen on the burning surface. Activated magnesium oxide formed from the decomposition adheres to the burning surface to prevent further combustion.

(2) Zinc borate (2ZnO.3B2O3.3.5H2O) releases crystallized water, which absorbs a large amount of heat energy thereby lowering the combustion temperature. It also dilutes the oxygen in the air to inhibits the combustion reaction. Zinc Borate eventually produces a B2O3 glassy film covering the inner layer to act as an insulation and oxygen barrier.

(3) Upon heating, calcium phosphate forms phosphoric acid and promotes carbon formation to reduce heat conduction from the flame to inner layer. The phosphoric acid inhibits oxidation of CO to CO2 thereby lowers the temperature of the combustion. It also forms a glassy or liquid protective layer on the surface of the polymer, which reduces oxygen diffusion heat transfer, inhibits the carbon oxidation process. It also contains phosphorus-containing flame retardant which is thermally decomposed as follows Phosphorus flame retardant→Phosphoric acid→phosphoric acid→polymetaphosphoric acid The polyphosphoric acid coats the surface of the polymer and isolate it from air. It has high water absorption ability and absorbs large amount of heat to allow the surface retardant on the polymer to heat up and decompose thereby releases PO. to capture H. and reduces combustion, i.e. PO.+H.=HPO.

(4) Diatomaceous earth is mainly cerium oxide. Its ignition point can be as high as 1600° C. which is an important flame retardation property. Its high porosity offers heat insulation and sound insulation properties.

(5) The flame retardation property is mainly attributable to the foaming agent and as detailed below.

(a), 4,4'-Oxybis(benzenesulfonyl hydrazide) burns at 155-165° C. to produce N2, an inert gas to suppress combustion and H2O in the form of water vapor to suppress combustion by lowering the temperature.

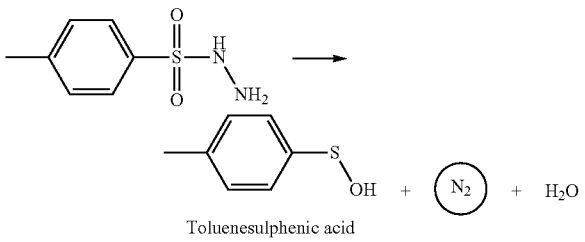

Toluenesulphenic acid (b) Sodium bicarbonate burns at 160-170° C. to produce CO2 which is an inert gas to suppress combustion and H2O in the form of water vapor to suppress combustion by lowering the temperature.

$$2NaHCO_3 \rightarrow Na_2CO_3+CO_2+H_2O$$

(c) Citric acid [Tricarboxylic acid] burns at 140-160° C. to produce CO2 which is an inert gas to suppress combustion and H2O in the form of water vapor to suppress combustion by lowering the temperature.

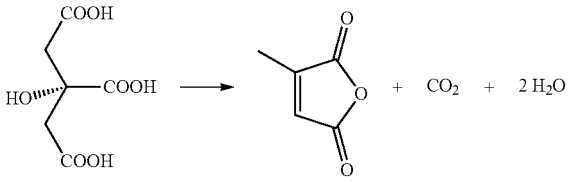

Experiment 1

In the experiment, a vertical flame is placed underneath a PVC board, which burns and penetrates the board in 18 minutes. The adding of foaming agent increases the time require to penetrate the board to 45 minutes.

The invention has been given by way of example only, and various other modifications of and/or alterations to the described embodiment may be made by persons skilled in the art without departing from the scope of the invention as specified in the appended claims.

The invention claimed is:

1. An extrusion component of a closure frame for defining an opening closable by a closure member, the extrusion component comprising:

an elongate body having first and second sides, at least one of the first and second sides is shaped for accommodating the closure member;

wherein the elongate body includes an inner layer comprising a first material, and an outer layer comprising a second material, and the outer layer is integrally formed with the inner layer, wherein the first material is different from the second material, wherein the inner layer has an outer surface correspondingly shaped by or with an inner surface of the outer layer and partially and non-continuously wrapped around by the outer layer, and the inner layer is substantially thicker than the outer layer, wherein the inner layer has an inner surface that defines a hollow interior configured to accommodate a reinforcement insert comprising a third material, wherein each of the first, second and third materials are different, wherein the reinforcement insert is attached to the inner layer by an adhesive and is configured to support installation of one or more accessories.

2. The extrusion component as claimed in claim 1, wherein the outer layer is formed from polyvinyl chloride (PVC).

3. The extrusion component as claimed in claim 1, wherein the third material of the reinforcement insert comprises a wood material.

4. The extrusion component as claimed in claim 1, wherein the outer layer comprises polyvinyl chloride (PVC) and the inner layer comprises polyvinyl chloride (PVC) and a foaming agent, and wherein the overall extrusion component is operable to attain a level of at least 30 minutes in a BS EN 1634 (2014) test.

5. The extrusion component as claimed in claim 1, wherein at least one of the first side and the second side includes one or more intumescent strip attached thereto.

6. The extrusion component as claimed in claim 1, wherein the inner layer is formed from polyvinyl chloride (PVC) and a foaming agent.

7. The closure frame extrusion component as claimed in claim 6, wherein the foaming agent comprises at least one of 4,4'-Oxybis(benzenesulfonyl hydrazide), sodium bicarbonate and Tricarboxylic acid.

8. The extrusion component as claimed in claim 6, wherein the inner layer further includes a material selected from a group comprising magnesium hydroxide, zinc borate, calcium phosphate and Diatomaceous earth.

9. The extrusion component as claimed in claim 1, wherein the first side of the elongate body includes a shaped retainer integrally formed with the first side of the elongate body for retaining an external part to be attached to the first side of the elongate body.

10. The extrusion component as claimed in claim 9, wherein the second side of the elongate body is at least partially devoid of an outer layer thereby exposing the inner layer.

11. The extrusion component as claimed in claim 9, wherein the second side is a mirror image of the first side.

12. The extrusion component as claimed in claim 9, wherein the first side of the elongate body includes an extension part integrally formed with the first side of the elongate body and spaced apart from the retainer for engaging the closure member.

13. The extrusion component as claimed in claim 12, wherein the retainer and the extension part run parallel to each other along the length of the elongate body and define a receiving zone for accommodating the closure member therein.

14. The extrusion component as claimed in claim 9, wherein a receiving zone includes a coupling part that couples with a co-operable coupling part on a bead for co-operatively holding a pane of glass.

15. The extrusion component as claimed in claim 14, wherein the coupling part is connected to the receiving zone by a connector.

16. The extrusion component as claimed in claim 14, wherein the retainer is shaped to engage a projection on the bead for fixing relative position of the extrusion component and the bead.

17. An extrusion component assembly comprising the extrusion component as claimed in claim 1 coupled to an extension part by a coupler.

18. The extrusion component assembly as claimed in claim 17, wherein the coupler includes a pair of recesses provided on the first and second sides of the component respectively for accommodating a pair of jaws on the extension part.

19. The extrusion component assembly as claimed in claim 17, wherein the assembly is sealed off on opposite sides of the assembly by respective covers connected to the connectors.

20. An extrusion component assembly, comprising four of the extrusion components of claim 1, the extrusion components are connected to one another by connectors to form the closure frame defining the opening therein, which is closable by the closure member;

one of the extrusion components is coupled to an extension part by a coupler, the elongate body having first and second sides, at least one of the first and second sides is shaped for accommodating the closure member;

the first side of the elongate body includes a shaped retainer integrally formed with the first side for retaining an external part to be attached to the first side of the elongate body;

wherein the elongate body includes the outer layer integrally formed with the inner layer and the inner layer has an outer surface correspondingly shaped by or with an inner surface of the outer layer.

21. An extrusion component assembly comprising two of the extrusion components as claimed in claim 9, wherein the extrusion components are connected by a connector and with their second sides arranged next to one another.

22. The extrusion component assembly as claimed in claim 21, wherein the second sides of the extrusion components define a gap into which a spacer is placed.

23. The extrusion component assembly as claimed in claim 22, wherein the spacer includes one or more ribs extending from a main body for maintaining the gap.

24. The extrusion component assembly as claimed in claim 22, wherein the gap is concealed by a cover engaging one end of the spacer.

25. A method of forming the closure frame extrusion component as claimed in claim 1, wherein the outer and inner layers of material are integrally formed and simultaneously shaped in a same extrusion step.

26. The method of claim 25, wherein the inner layer of material defines a hollow interior in the same extrusion step for accommodating an insert.

27. The method of claim 25 including the step of providing a second die inside a first die.

28. The method of claim 26 further including the step of supplying a first substrate of material between the first and second die and a second substrate into the second die whereby:

during extrusion, forming an extrusion component of a closure frame defining an opening which is closable by a closure member, the first substrate of material forms an outer layer of the closure frame component and the second substrate of material forms an inner layer of the same closure frame component in a single step of extrusion, an elongate body having first and second sides, at least one of the sides is shaped for accommodating the closure member, wherein the elongate body includes an outer layer integrally formed with an inner layer and the inner layer has an outer surface correspondingly shaped by or with an inner surface of the outer layer.

* * * * *